US006687937B2

(12) United States Patent
Harker

(10) Patent No.: US 6,687,937 B2
(45) Date of Patent: Feb. 10, 2004

(54) MOISTURE DRYING MATTRESS WITH SEPARATE ZONE CONTROLS

(75) Inventor: Ruth K. Harker, St. Louis, MO (US)

(73) Assignee: Crown Therapeutics, Inc., Belleville, IL (US)

( * ) Notice: Subject to any disclaimer, the term of this patent is extended or adjusted under 35 U.S.C. 154(b) by 86 days.

(21) Appl. No.: 10/147,411

(22) Filed: May 16, 2002

(65) Prior Publication Data

US 2002/0129449 A1 Sep. 19, 2002

Related U.S. Application Data

(63) Continuation-in-part of application No. 09/584,867, filed on Jun. 1, 2000.

(51) Int. Cl.[7] ..... A47C 21/04; A47C 27/10; A61G 7/057

(52) U.S. Cl. ..... 5/726; 5/423; 5/706; 5/710; 5/714; 5/699; 5/737

(58) Field of Search ..... 5/726, 722, 724, 5/727, 728, 706, 707, 710, 713, 714, 737, 738, 421, 423, 484, 699, 652.1, 652.2, 654, 655.3, 657, 914, 935, 944, 485

(56) References Cited

U.S. PATENT DOCUMENTS

| | | | |
|---|---|---|---|
| 134,424 | A | 12/1872 | Evans |
| 562,606 | A | 6/1896 | Henry |
| 853,049 | A | 5/1907 | Weston |
| 1,123,345 | A | 1/1915 | Micon |
| 1,579,074 | A | 3/1926 | Burton |
| 1,852,811 | A | 4/1932 | Koken et al. |
| 1,914,661 | A | 6/1933 | Burke |
| 2,493,067 | A | 1/1950 | Goldsmith |
| 2,913,833 | A | 11/1959 | Glintz |
| 3,209,380 | A | 10/1965 | Watsky |

(List continued on next page.)

FOREIGN PATENT DOCUMENTS

| | | |
|---|---|---|
| AU | 221200 | 3/1959 |
| DE | 3320771 | 12/1984 |
| GB | 2032269 | 5/1980 |
| GB | 2161376 | 1/1986 |
| GB | 2225229 | 5/1990 |
| GB | 2244000 | 11/1991 |
| IT | 626272 | 10/1961 |
| JP | 515557 | 1/1993 |
| WO | WO8804548 | 6/1988 |

OTHER PUBLICATIONS

*Pressure Ulcers and Patient Support Surfaces.*
Oliver H. Bodine, Jr., President, GSI Medical Systems, Inc. *CareMedx™; Air Express APM™; Sure–Float™; Air Express LAL™; Tru–Turn™; Air Prism™; Aire Select™ P/2500.*

(List continued on next page.)

*Primary Examiner*—Robert G. Santos
(74) *Attorney, Agent, or Firm*—Polster, Lieder, Woodruff & Lucchesi, L.C.

(57) ABSTRACT

A moisture drying mattress comprised of at least one cushion that has opposite top and bottom surfaces and a plurality of apertures that extend through the cushion from the bottom surface to the top surface. An air channel mat is positioned below the cushion. The air channel mat is adapted and dimensioned to fit beneath the cushion and support the cushion bottom surface in a spaced relation above a bottom base of the mat to thereby form an air flow space between the cushion and mat through which air can flow. A vapor permeable, liquid impermeable cover encases the air channel mat and the cushion defining a vapor evaporation area under the cover. The air channel mat defines a moisture drying zone within the vapor evaporation area. An air pump is provided for selectively supplying a flow of air to the air channel mat. A controller is provided to control the flow of air to the air channel mat to evaporate the vapor in the vapor evaporation area. In an alternative embodiment, the air channel mat is positioned above the cushion.

45 Claims, 9 Drawing Sheets

U.S. PATENT DOCUMENTS 3,266,064 A 8/1966 Figman
3,303,518 A 2/1967 Ingram
3,525,549 A 8/1970 Knabusch et al.
3,605,145 A 9/1971 Graebe
3,653,083 A 4/1972 Lapidus
3,681,797 A 8/1972 Messner
3,778,851 A 12/1973 Howorth
3,870,450 A 3/1975 Graebe
4,005,236 A 1/1977 Graebe
4,225,989 A 10/1980 Corbett et al.
4,279,044 A 7/1981 Douglas
4,347,633 A 9/1982 Gammons et al.
4,365,371 A 12/1982 Boussaroque
4,391,009 A 7/1983 Schild et al.
4,472,847 A 9/1984 Gammons et al.
4,541,136 A 9/1985 Graebe
4,556,254 A 12/1985 Roberts
4,599,756 A 7/1986 Koffler
4,605,582 A 8/1986 Sias et al.
4,622,706 A 11/1986 Takeuchi
4,629,246 A 12/1986 Fulton
4,662,012 A 5/1987 Torbet
4,673,605 A 6/1987 Sias et al.
4,698,864 A 10/1987 Graebe
4,728,119 A 3/1988 Sigafoo
4,753,482 A 6/1988 Warren
4,825,488 A 5/1989 Bedford
4,847,933 A 7/1989 Bedford
4,864,671 A 9/1989 Evans
4,866,800 A 9/1989 Bedford
4,949,412 A 8/1990 Goode
4,969,223 A 11/1990 Yamaguchi
4,981,325 A 1/1991 Zacharkow
4,982,466 A 1/1991 Higgins et al.
4,986,738 A 1/1991 Kawasaki et al.
5,002,336 A 3/1991 Feher
5,028,065 A 7/1991 Danecker
5,052,068 A 10/1991 Graebe
5,062,169 A 11/1991 Kennedy et al.
5,085,653 A 2/1992 Levy
5,090,076 A 2/1992 Guldager
5,102,195 A 4/1992 Axelson et al.
5,111,544 A 5/1992 Graebe
5,127,709 A 7/1992 Rubinstein et al.
5,129,115 A 7/1992 Higgins et al.
5,152,023 A 10/1992 Graebe
5,156,226 A 10/1992 Boyer et al.
5,163,196 A 11/1992 Graebe et al.
5,193,237 A 3/1993 Holdredge
5,249,318 A 10/1993 Loadsman
5,265,933 A 11/1993 Crowshaw
5,269,589 A 12/1993 Brothers et al.
5,274,846 A 1/1994 Kolsky
5,297,021 A 3/1994 Koerlin et al.
5,364,162 A 11/1994 Bar et al.
5,369,828 A 12/1994 Graebe
5,373,595 A 12/1994 Johnson et al.
5,379,471 A 1/1995 Holdredge
5,416,935 A 5/1995 Nieh
5,419,571 A 5/1995 Vaughan
5,444,881 A 8/1995 Landi et al.
5,474,361 A 12/1995 Hwang et al.
5,493,742 A 2/1996 Klearman
5,502,855 A 4/1996 Graebe
5,503,459 A 4/1996 White
5,509,155 A 4/1996 Zigarac et al.
5,533,217 A 7/1996 Holdredge
5,533,220 A 7/1996 Sebag et al.
5,538,326 A 7/1996 Lorbiecki
5,539,942 A 7/1996 Melou
5,547,251 A 8/1996 Axelson
5,561,875 A 10/1996 Graebe
5,564,788 A 10/1996 Warhaftig
5,567,095 A 10/1996 James et al.
5,582,464 A 12/1996 Maymon
5,590,428 A 1/1997 Roter
5,596,778 A 1/1997 Suzuki et al.
5,596,781 A 1/1997 Graebe
5,640,728 A 6/1997 Graebe
5,645,314 A 7/1997 Liou
5,655,237 A 8/1997 Suzuki et al.
5,687,438 A 11/1997 Biggie et al.
5,689,845 A 11/1997 Sobieralski
5,699,570 A 12/1997 Wilkinson et al.
5,701,621 A 12/1997 Landi et al.
5,715,695 A 2/1998 Lord
5,745,941 A 5/1998 Miller, Sr.
5,749,109 A 5/1998 Kappel
5,787,534 A 8/1998 Hargest et al.
5,794,288 A 8/1998 Soltani et al.
5,836,027 A 11/1998 Leventhal et al.
5,839,140 A 11/1998 Wilkerson
5,884,928 A 3/1999 Papac
5,887,304 A 3/1999 von der Heyde
5,902,011 A 5/1999 Hand et al.
5,904,398 A 5/1999 Farricielli
5,906,416 A 5/1999 Rasmussen
5,926,884 A 7/1999 Biggie et al.
5,944,385 A 8/1999 Pearce
5,984,418 A 11/1999 McInturff
5,996,716 A 12/1999 Montiglio et al.
6,014,784 A 1/2000 Taylor et al.
6,052,853 A 4/2000 Schmid
6,108,843 A 8/2000 Suzuki et al.
RE37,026 E 1/2001 Whalen
6,178,578 B1 1/2001 Soltani et al.
6,212,718 B1 4/2001 Stolpmann et al.
6,274,520 B1 8/2001 Cordell
6,305,747 B1 10/2001 Mei
6,317,912 B1 11/2001 Graebe et al.
6,336,237 B1 1/2002 Schmid
6,370,718 B1 4/2002 Schmid
6,487,739 B1 * 12/2002 Harker ..... 5/726
2002/0129449 * 9/2002 Harker ..... 5/726

OTHER PUBLICATIONS

Plexus Medical.
*BASE™ LARGE CELL™ Low Air Loss Alternating Pressure System.*
Progressive.
*The StageZero™ AL–1A Power Air Flotation Bed System.*
Air Superiority.
*Sequential Anti–Decubitus Mattress Replacement Systems.*
Talley.
*The VÖLKNER SYSTEM®.*
James Manufacturer & Distributor.
*Hospital to Home Portable Patient Support.*
Aeromat MRS–1000.
*The Tissue Integrity System of Tomorrow.*
The Bazook System.
Innovative Medical Systems Inc.
*The StageZero™ AL–1A Power Air Flotation Bed System.*
Air Superiority.
*Home–Kair™ Bed—Low Air Loss, Pressure Relief Therapy.*
Homedco.
*AirMatt Non Powered Adjustable Zone Mattress Overlay.*
Compass.

*A National Network of Health Care Providers.*
Dermanet.
*American Bantex Alternating Pressure Pump & Mattress System.*
Bantex.
*"Elite" Alternating Therapy Air Pump and Super Low Air Loss Mattress.*
Apex Health Care Mfg. Inc.
*Conforma Aire™ The Portable Therapy Bed.*
Anatomic Therapy Systems.
*NatureSleep Aire™ The Portable Therapy Bed.*
Anatomic Therapy Systems.
*ALAMO Alternating Low Airloss Mattress Overlay.*
National Patient Care Systems.
*microAIR™ 1000.*
GSI Medical Systems.
*BASE™ DEEP CELL™ Low Air Loss Alternating Pressure Mattress.*
Progressive.
*SPR–Plus Air Loss Therapy.*
Gaymar.
*The One Piece Low Air Loss Mattress System.*
REM–AIR.
*APREMA II Advanced Air Support Therapy.*
MAMI.
*Relieving The Pressures—Alphacare®.*
Huntleigh Technology.
*Pressure Reliever.*
Bio Clinic—A Division of Sunrise Medical.
*ClassicAir™—Akro Tech®.*
Lumex.
*Maximizing patient care through appropriate service and product selection.*
KCI.
*Orthoderm Therapy Products—The Future of Air Therapy Beds.*
Sunrise Medical/Bio Clinic.
*Low Airloss Therapy.*
Silkair.
*Orthoderm Convertible.*
Orthoderm Convertible.
*Clini–Care.*
CSI—Clinicair Systems, Inc.
*PNEU–CARE PLUS+™.*
Special Care Delivery.
*ASAP Air Suspension and Pulsation Therapy System.*
DynaMedics Corporation.

* cited by examiner

MOISTURE DRYING MATTRESS WITH SEPARATE ZONE CONTROLS

CROSS-REFERENCE TO RELATED APPLICATIONS

This application is a continuation-in-part of application Ser. No. 09/584,867, filed Jun. 1, 2000.

BACKGROUND OF THE INVENTION (i) Field of the Invention

The present invention relates in general to cushioning devices, in particular to a mattress comprised of an air cell mattress with a plurality of apertures extending through the air cell mattress, a plurality of air channel mats residing beneath the air cell mattress, a top and bottom cover, and an air pump with a controller. The air pump communicates with the air channel mats to provide a flow of air to the bottom of the air cell mattress which flows upwardly through the plurality of apertures to remove moisture vapor which has accumulated below the cover. These mattresses typically are used in a hospital setting for users that are severely disabled or debilitated and readily cannot move.

(ii) Description of the Related Art

Over the years various mattresses for use in therapeutic care and the prevention of pressure ulcers on the user of the mattress have been developed. Pressure ulcers are red areas or open sores on the skin, often accompanied by indications that the skin and surrounding tissue is in the process of dying and decomposing. Pressure ulcers are caused by damage to the body's soft tissue in areas where bone is close to the skin. Pressure ulcers, also known as bed sores, can occur over any boney part of the body such as the heels, hips and back. Users who are severely disabled or debilitated and cannot move are ideal candidates for developing pressure ulcers. These users are apt to lie or sit motionless in one position for long periods of time (hours). The major causes of pressure ulcers include (1) oxygen and nutrient starvation of the soft tissue; (2) pressure; (3) friction and skin shear; (4) excess moisture or moisture build-up at the skin; and (5) heat build-up in the tissue. Pressure at the user-mattress interface can constrict capillary blood flow and starve body tissue of oxygen and nutrients. The starvation of the tissue causes the tissue to began to die and decompose, causing the formation of a pressure ulcer.

While the interface pressure is very important, other factors also contribute to developing pressure ulcers. Friction and skin shear forces intensify the damaging effects of interface pressure. Friction results in abrasion damage to the skin surface. Skin shear is the horizontal force between the user and the mattress surface that produces tearing forces within deeper tissues. Skin shear can occur when a user is positioned or slides on a bed surface, stretching and damaging skin, connective-tissue, muscle and blood vessels. Excess moisture or moisture build-up at the user-mattress interface can be absorbed through the skin and possibly result in over-hydration of the skin. Over-hydration of the skin dramatically reduces soft tissue strength and increases the potential for friction/shear damage. Excess moisture on the mattress also raises the drag friction of the user-mattress interface due to liquid surface tension and can greatly increase friction and shear damage. Another factor contributing to the development of pressure ulcers is heat build-up in the tissue. Elevated tissue temperatures increase cellular metabolism and the subsequent need for oxygen and nutrients. Typically, the prior art mattresses designed to prevent pressure ulcers employ some type of air cell mattress wherein the individual air cells communicate with one another so as to evenly distribute the supporting force over the body of the user of the mattress. While the use of mattresses that provide a uniform supporting force reduces the possibility of developing pressure ulcers, other factors need to be addressed in order to further diminish the possibility of a user developing pressure ulcers.

For example, excess moisture or moisture build-up at the user-mattress interface can result in over-hydration of the skin along with an increase in the friction and skin shear forces experienced by the user, which greatly enhance the potential for developing pressure ulcers. To overcome the excess moisture build-up, prior art mattresses have employed methods of providing a flow of air through the mattress and along the user-mattress interface to remove any built-up moisture and minimize the potential for moisture to build-up. These mattresses included the use of an air pump to supply a flow of air to an air distribution member residing beneath the mattress which flows between the air distribution member and an inflatable mattress and then upwardly through the mattress to the user-mattress interface. These prior art mattresses use a single air distribution member to provide the flow of air to the mattress. However, these mattresses had a drawback in that, the use of a single air distribution member does not provide the flexibility to custom tailor the flow of air to different parts of the mattress to provide different levels of comfort and moisture removal for the user of the mattress.

Typical prior art mattresses also employ a single air pump to supply air to both the inflatable mattress and the air distribution member. The use of a single pump to provide air to the the inflatable mattress and to provide a flow of air to the mattress air distribution member to remove moisture increases the complexity and cost of the air supply system and prevents the use of other manufacturer's mattresses. The complexity of the air supply system for both the mattress air cells and the air distribution member may also be difficult for a user to understand and control.

Some prior art mattresses utilize air from the air cells to provide a flow of air from the mattress to remove moisture. A typical mattress of this type uses low air loss air cells wherein the air cells are constantly venting a small amount of air out of the air cells as new air is being continuously pumped into the air cells. The air venting from the air cells provides the air flow to the mattress to remove the moisture. Additionally, other mattresses systematically inflate and deflate some of the air cells of the air cell mattress in order to relieve pressure on the user of the mattress. The deflation of the air cells provides an exhaust flow of air that is routed from the mattress to remove moisture therefrom.

Some prior art mattresses also utilize drainage holes in the mattress to remove large amounts of liquid that may be excreted by a user of the mattress, such as urine. While this aids in the removal of the liquid moisture, it does not remove moisture vapor and allows for a potentially unsanitary and non-hygenic mattress. The use of this type of mattress requires the mattress to be cleaned and disinfected after having been contaminated.

SUMMARY OF THE INVENTION

The present invention overcomes shortcomings of prior art mattresses by providing a cushion that provides a uniform supporting force over a large area, a cover that provides a smooth surface for the user to lay on that is vapor permeable and liquid impermeable, and an air channel mat for supplying air to the cushion to evaporate and remove moisture vapor from between the cover and the cushion. Furthermore, the present invention provides for a plurality of air channel mats that are supplied with a flow of air from an air pump that can selectively control which parts of the mattress are supplied with a flow of air to evaporate and moisture.

An effective therapeutic mattress that minimizes the possibility of pressure ulcers will (1) distribute pressure as evenly as possible along a user's body; (2) have a low friction user-mattress interface that minimizes the skin shear forces; and (3) actively removes excess user-mattress moisture vapor.

The moisture drying mattress of the invention is comprised of at least one cushion that has opposite top and bottom surfaces and a plurality of apertures that extend through the cushion from the bottom surface to the top surface. An air channel mat is positioned below the cushion. The air channel mat is adapted and dimensioned to fit beneath the cushion and support the cushion bottom surface in a spaced relation above a bottom base of the mat to thereby form an air channel between the cushion and mat through which air can flow. An air pump is provided for selectively supplying a flow of air to the air channel mat. A controller is provided to control the flow of air to the air channel mat. A cover encases the air channel mat and the cushion.

In one exemplary embodiment, the cushion is an inflatable air cell mattress comprised of a plurality of air cells. The air cells are interconnected to permit air flow between the air cells and are preferably cubic in shape with a domed top. The inflated air cell mattress provides a uniform supporting force for the user of the mattress to minimize the pressure concentrations on the user. The distribution of the supporting force helps to prevent the occurrence of pressure ulcers. A plurality of apertures are provided in the cushion that extend through the base sheet and top sheet of the air cell mattress but do not communicate with the air cells. The apertures provide a path through which air can flow from the air channel mat upwardly through the apertures and between the air cells and to an area between the mattress and cover to remove moisture.

In the exemplary embodiment, the air channel mat is a plurality of air channel mats that are each dimensioned and adapted to fit beneath a portion of the cushion and support the cushion bottom surface in a spaced relation above the base of the air channel mat. The air channel mats each have a peripheral edge separating opposite top and bottom surfaces of the base. An air supply connector is associated with each air channel mat along its peripheral edge. Air supply connector can be part of the air channel mat or can be in the cover. A plurality of projections extend upwardly from the base top surface of each air channel mat and engage with the cushion bottom surface to support the cushion bottom surface in a spaced relation above the base top surface and create a channel into which air can flow between the air channel mat base and the cushion bottom surface. In another exemplary embodiment, the air channel mat is comprised of a three dimensional, resilient and air permeable support fabric.

In one exemplary embodiment, each air channel mat is also provided with a skirt that extends along a portion of the air channel mat peripheral edge. The skirt extends over the air supply connector and along a portion of the peripheral edge on both sides of the air supply connector. The skirt extends inwardly from the peripheral edge to cover a portion of the top surface of the base and the projections that extend upwardly from the base. The skirt serves to secure the air supply connector to the air channel mat and prevents the flow of air to the air channel mat from escaping along the portion of the peripheral edge with the skirt. In another embodiment, the air channel mat is without a skirt and the air connector is associated with the bottom cover.

In the exemplary embodiment, the air pump has a plurality of air outlets, with each outlet being controlled by a valve that is selectively positionable between opened and closed positions. The outlets are connected with the air supply connectors of the air channel mats, with each outlet being associated with one air channel mat and providing a flow of air from the air pump to the associated air channel mat when in the opened position. When the valves are in the closed position they prevent a flow of air from the air pump outlets to their associated air channel mats. The valves thereby allow a user to selectively choose which air channel mats receive a flow of air from the air pump.

In the exemplary embodiment, the air pump includes an air supply controller that controls the valves and the air pump and has a plurality of selectively adjustable inputs, the inputs controlling the opening and closing of the valves and the operation of the air pump. The inputs control a cyclic opening and closing of the valves for predetermined periods of time. The selectively adjustable inputs thereby enable a user to custom tailor the air flow to the mattress and the subsequent moisture removal.

In the exemplary embodiment, the cover is dimensioned and adapted to enclose the cushion and the air channel mats. The cover has a top sheet with a peripheral edge and a bottom sheet with a peripheral edge. The top and bottom sheets are connected together along portions of their peripheral edges, leaving an opening between the peripheral edges that provides access to an interior of the cover between the top sheet and bottom sheet.

Preferably, the bottom sheet has opposite top and bottom surfaces. The bottom sheet top surface has a plurality of pockets dimensioned and adapted to receive the air channel mats. The pockets are comprised of a U-shaped frame having an outer peripheral edge, an inner peripheral edge, and a margin extending between the outer and inner peripheral edges. The outer peripheral edge is secured to the bottom sheet top surface and the frame margin of the pocket overlaps a portion of the top of the air channel mat, thereby holding the air channel mat in the pocket. A portion of the air channel mat beneath the frame opening is exposed to the cushion bottom surface so that the mat projections engage with the cushion bottom surface to support the cushion bottom surface in a spaced relation above the air channel mat base.

Preferably, each pocket separates each of the air channel mats and forms a seal between the pocket and the cushion bottom surface. The seal directs the flow of air from the air pump through the air channel mat and then upwardly through the apertures in the portion of the cushion that is above the air channel mat, enabling the flow of air to be directed to the desired portion of the cushion.

In the exemplary embodiment, the top sheet of the cover has a top surface, upon which the user will interface with the mattress, that is both vapor permeable and liquid impermeable. The top sheet is comprised of a nylon sheet laminated to a urethane sheet. The nylon sheet is above the urethane sheet so that a user of the mattress will interface with the nylon sheet and the urethane sheet is positioned between the nylon sheet and the cushion top surface. The laminated top sheet allows moisture vapor to permeate into the cover and prevents liquid on the top surface of the cover from entering the mattress and contaminating the cushion and air channel mats. The moisture vapor is trapped between the cover and the mattress.

The use of a nylon sheet as the interface between the mattress and the user reduces the friction between the cover and the user and thereby minimizes the possibility of the user developing pressure ulcers from friction or skin shear. Additionally, by utilizing a flow of air to remove the moisture vapor from between the cover and the mattress, more moisture vapor will be removed from the mattress-user interface. The user's skin is less likely to over-hydrate and as a result the soft tissue is strong enough to reduce the potential for friction and/or skin shear damage.

In another exemplary embodiment the vapor drying mattress includes at least one cushion, a cover over the cushion having a top and a bottom, with the top including an outer layer and an inner layer laminated to said top layer. The cover is impermeable to fluid but permeable to moisture vapor. The cover includes at least on pocket at the bottom layer of the cover top with a light weight, flexible air diffuser positioned in pocket. The pocket and air diffuser define a moisture drying zone below said cover. An air pump operatively connected to the pocket selectively supplyies an air flow to the air diffuser. The air flow supplied to the air diffuser flows through the air diffuser, generally downward toward the moisture drying zone to remove moisture vapor by a flow of air in the moisture drying zone.

The moisture drying mattress of the present invention overcomes the disadvantages of the prior art. The use of a plurality of air channel mats that can be selectively supplied with a flow of air from an air pump allows the user to selectively choose which portions of the mattress receive the vapor drying air flow. The use of a cover having a top surface upon which the user will interface that is made of a nylon sheet laminated to a urethane sheet keeps liquids out of the mattress while allowing the moisture vapor to pass through the cover and contact air flow around the mattress to remove the moisture vapor. The nylon surface provides a smooth, low friction surface upon which the user interfaces with the mattress and reduces the risk of damage to a user's skin. The use of an air mattress that distributes a supporting force over the entire portion of the user's body that is in contact with the mattress further reduces the possibility of developing pressure ulcers.

BRIEF DESCRIPTION OF THE DRAWINGS

Further objectives and features of the present invention are set forth in the following detailed description of the preferred embodiment of the invention and in the drawing figures wherein.

DETAILED DESCRIPTION OF THE INVENTION

Figure 1:
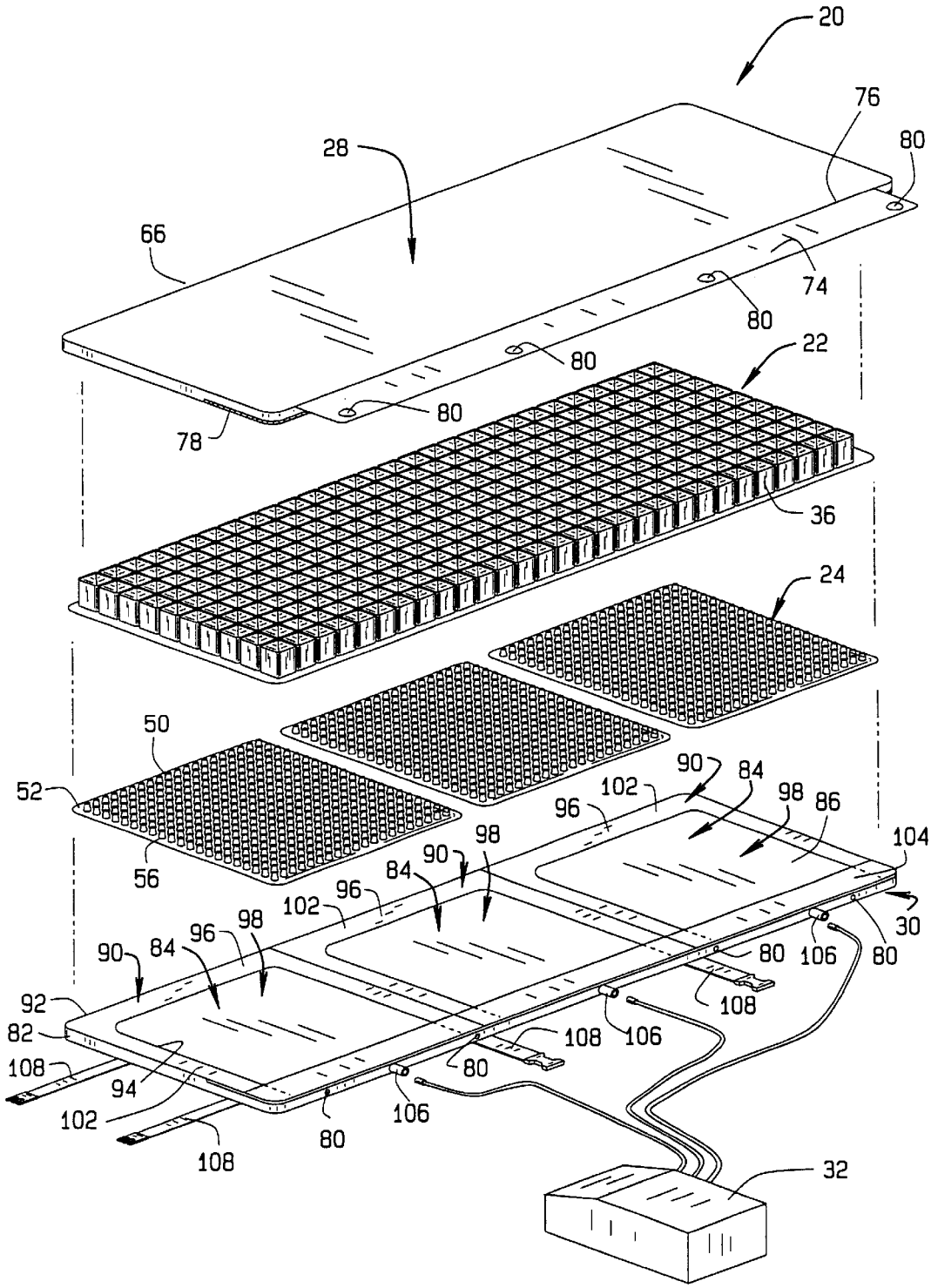
FIG. 1 is a perspective, exploded view of the mattress.
Figure 2:
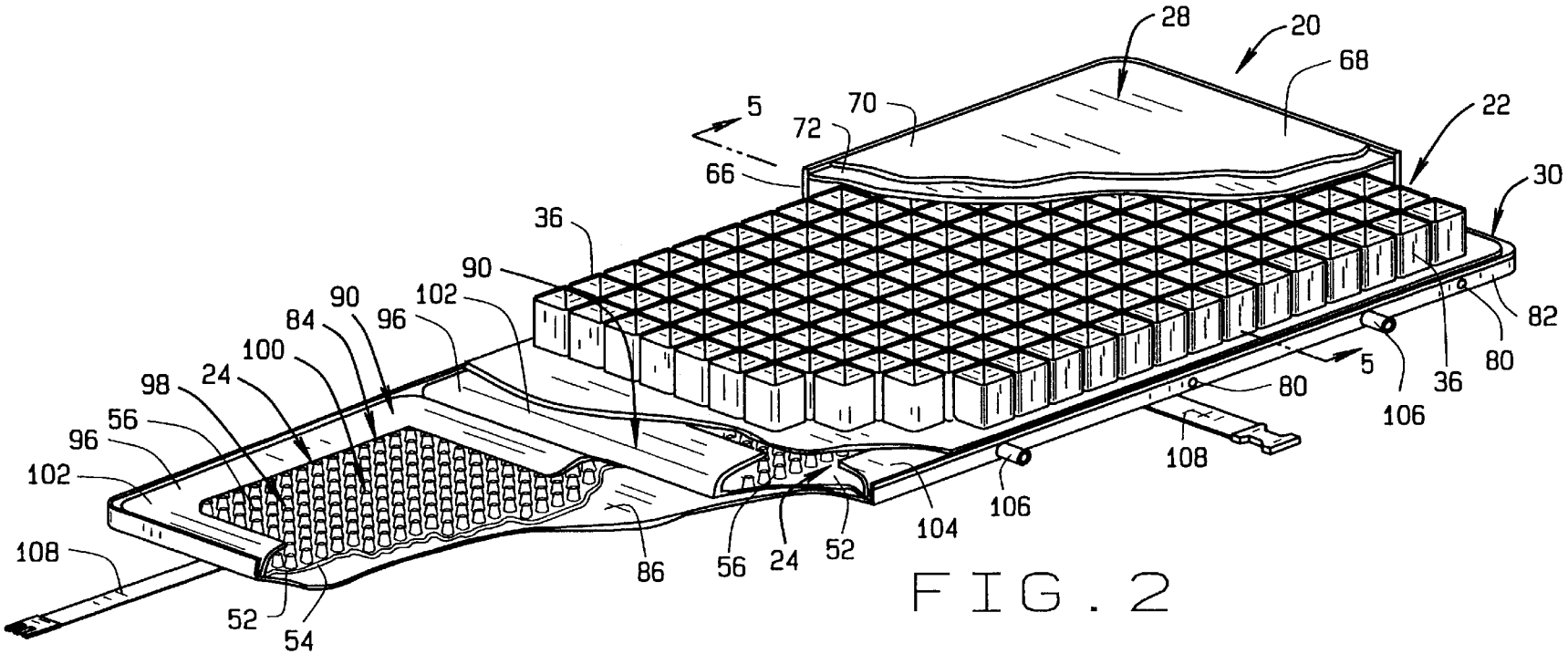
FIG. 2 is a perspective, partially cut-away view of the mattress.
Figure 4:
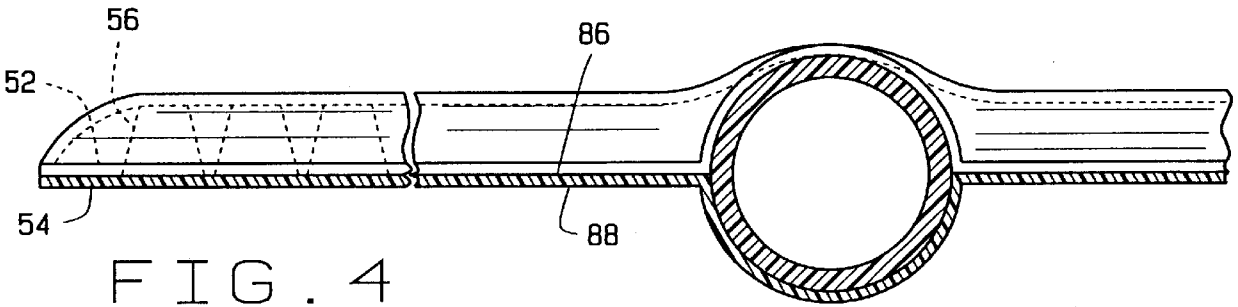
FIG. 4 is a cross-sectional view of a portion of the air channel mat of FIG. 3 taken along line 4—4.

FIG. 1 shows the components of the moisture drying mattress 20. The moisture drying mattress 20 is basically comprised of a cushion 22 which is shown in the exemplary embodiment as an inflatable air cell mattress, a plurality of air channel mats 24, a cover 26 having a top sheet 28 and a bottom sheet 30, and a controller 32 containing an air pump 34.

The air cell mattress could be any of a variety of commercially available air cell mattresses so long as the commercially available air cell mattress has apertures that extend through the air cell mattress to enable a flow of air to pass from beneath the air cell mattress upwardly through the apertures and between the air cells and to the cover top sheet 28. In the illustrated embodiment, the air cell mattress 22 is comprised of a plurality of air cells 36. The air cell mattress 22 is constructed in a similar manner to that of the air cell mattresses described in U.S. Pat. Nos. 5,561,875 and 5,596,781, incorporated herein by reference. The air cell mattress 22 is comprised of a generally flat base sheet 38 and a top sheet 40, each made from an air impervious material such as vinyl or plastic. The air cell mattress top sheet 40 is molded to form a plurality of air cells 36 and is fixed to the air cell mattress base sheet 38. The air cell mattress top sheet 40 is fixed to the air cell mattress base sheet 38 around the bottom edges 42 of the air cells 36, except for portions of the air cell bottom edges 42 that are left open between the air cell mattress top sheet 40 and the air cell mattress base sheet 38. These portions of the air cell bottom edges communicate with internal air channels (not shown) left open between the air cell mattress top sheet 40 and the air cell mattress base sheet 38 that provide a path for air flow between the air cells 36. Each air cell 36 preferably has a generally is cubical shape with four walls 44 extending outwardly from the air cell mattress base sheet 38. A triangular panel 46 extends from the top-most edge of each of the walls 44 and the triangular panels 46 come together to define a pyramidal or dome shaped surface at the top of each of the independent air cells 36. Additionally, there are a plurality of apertures 48 that extend through the air cell mattress base sheet 38 and top sheet 40 but do not communicate with the air cells 36. The apertures 48 provide a flow path for a flow of air supplied by the air pump 34 to flow upwardly from beneath the air cell mattress 22 through the apertures 48 and between the air cells 36 as will be explained.

While the preferred embodiment utilizes the air cell mattress 22 described, it should be understood that any type of cushion, including a cushion that does not distribute the supporting forces over large areas of a user's body, that has a plurality of apertures extending through the cushion providing a flow path for an air flow from the air pump 34 can be utilized with the other component parts of the invention to be described. The cushion can be another inflatable mattress or a non-inflatable mattress.

Figure 3A:
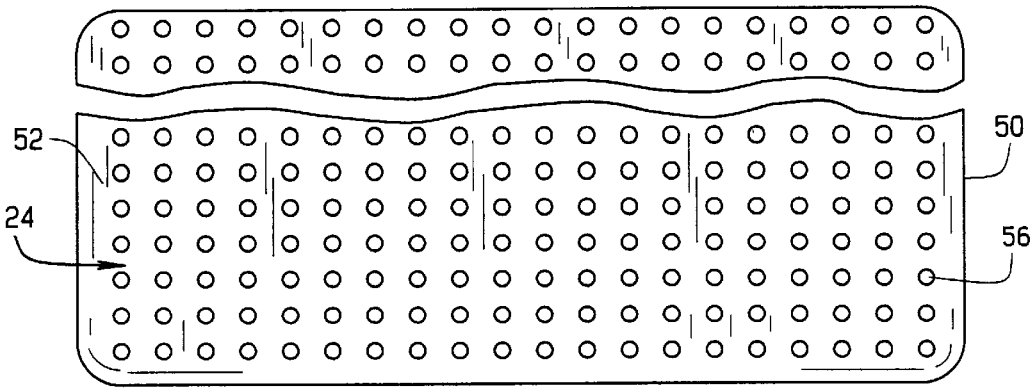
FIG. 3A is a segmented plan view of the top of an air channel mat.

In the preferred embodiment, as shown in FIG. 3A, the air channel mats 24 each have a peripheral edge 50 that separates opposite top and bottom surfaces 52, 54 of the air channel mats 24. A plurality of projections 56 extend upwardly from the air channel mat top surface 52. The mats with their projections are preferably molded of plastic. The projections 56 are generally conical with their apexes being truncated. The plurality of projections 56 engage with the air cell mattress base sheet 38 to support the air cell mattress base sheet 38 in a spaced relation above the air channel mat top surface 52 to thereby allow a flow of air to flow between the air channel mat top surface 52 and the air cell mattress base sheet 38. While the plurality of projections 56 have been shown as truncated cones, it is to be understood that any configuration of the projections that will support the air cell mattress base sheet 38 in a spaced relation from the air channel mat top surface 52 will suffice and are included within the scope of the invention. While the air channel mats 24 are shown as being rectangular, it should be understood that any configuration for the air channel mats 24 that can reside beneath the air cell mattress 22 can be utilized without departing from the scope of the invention. In addition, although three air channel mats are preferred, other numbers could be employed.

Figure 3B:
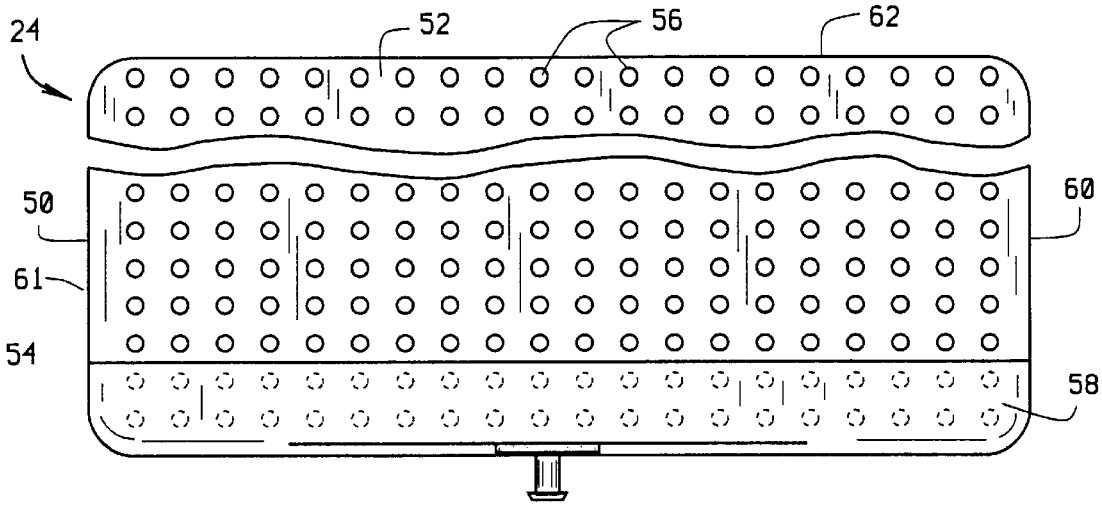
FIG. 3B is a segmented plan view of the top of an alternative embodiment of the air channel mat.

In another embodiment, the air channel mats 24 each have a skirt 58, as can best be seen in FIG. 3B, that is attached to the peripheral edge 50 along one side 59 of the mat and along portions of adjacent sides 60, 61 of the mat 24. The skirt 58 extends over a portion of the projections 56 and the air channel mat top surface 52. Also included along the skirt side 59 of the air channel mat is an air supply connector 64. The skirt 58 goes over the air supply connector 64 so that the air supply connector 64 is sealed between the air channel mat top surface 52 and the skirt 58. The air supply connector 64 is dimensioned and adapted to receive a flow of air from the air pump 34. In the preferred embodiment, the skirt 58 is attached to the peripheral edge 50 by heat welding or heat sealing the skirt 58 to the air channel mat 24. The heat sealing of the skirt 58 to the air channel mat 24 provides an air tight engagement between the skirt 58, the air supply connector 64, and the air channel mat 24. The skirt serves to secure the air supply connector 64 to the air channel mat 24 and also to direct air flowing through the air supply connector 64 over the air channel mat top surface 52. The air pump 34 is connected to each air supply connector 64 by tubing 65. The tubing 65 provides a flow path for a flow of air between the air pump 34 and the air supply connectors 64.

The plurality of projections 56, the skirt 58, and is the air supply connector 64 are all made of a flexible plastic or plastic-type material. The use of a flexible material in the construction allows for flexibility in using the moisture drying mattress 20 on uneven surfaces and for conveniently folding and storing the moisture drying mattress 20. However, it should be understood that the use of rigid or less pliable materials in constructing the air channel mats 24, the plurality of projections 56, the skirt 58 and/or the air supply connector 64 is also possible without departing from the scope of the invention.

Figure 5:
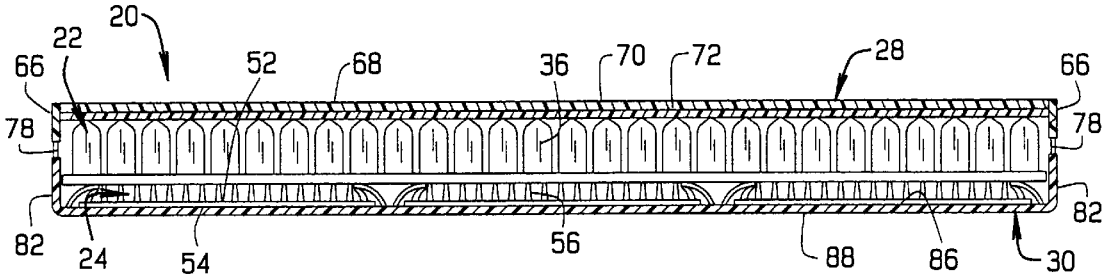
FIG. 5 is a cross-sectional view of the mattress of FIG. 2 taken along line 5—5.
Figure 8:
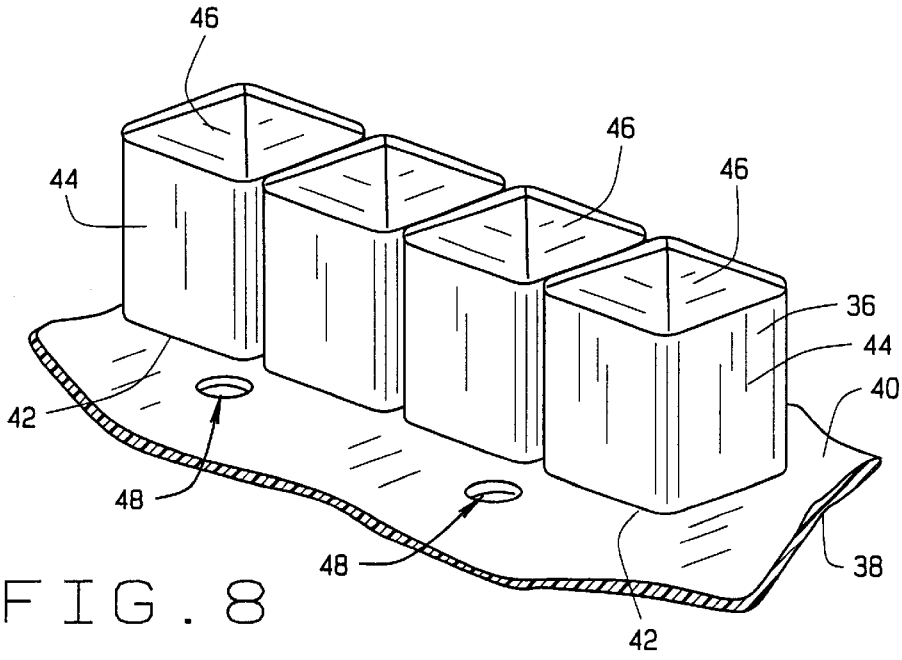
FIG. 8 is a partial cut-away view of some of the air cells of the air cell mattress showing the apertures extending through the air cell mattress.

In the preferred embodiment, the cover top sheet 28 has a peripheral edge 66 that extends around a top surface 68 of the cover top sheet 28. The cover top sheet top surface 68 is preferably comprised of a sheet of nylon 70 laminated to a sheet of urethane 72, as can best be seen in FIG. 5. The nylon sheet 70 provides a smooth surface for the interface between a user and the moisture drying mattress 20. The use of a nylon sheet 70 laminated to a urethane sheet 72 provides a cover top sheet top surface 68 that is vapor permeable and liquid impermeable. As best seen in FIG. 1, a flap 74 is attached to the cover top sheet 28 along one side 76 of the cover top sheet. A zipper 78 is located along a portion of the cover top sheet peripheral edge 66. The flap 74 has snaps 80 for selectively attaching the flap 74 to the cover bottom sheet 30. The flap 74 serves to cover a portion of the zipper 78 and the connections between the tubing 65 and the air channel mats 24.

The zipper 78 serves to selectively connect a portion of the cover top sheet 28 to a complementary portion of the cover bottom sheet 30. While a nylon sheet 70 laminated to a urethane sheet 72 is used to provide a cover top sheet 28 that is vapor permeable and liquid impermeable, it should be understood that other materials may be utilized to make the cover top sheet 28 vapor permeable and liquid impermeable without departing from the scope of the invention. In the preferred embodiment, the cover bottom sheet 30 has a peripheral edge 82. A mating half of the zipper 78 runs along a portion of the cover bottom sheet peripheral edge 82. Preferably, the cover bottom sheet 30 is connected to the cover top sheet 28 along complementary portions of the cover bottom sheet peripheral edge 82 and cover top sheet peripheral edge 66. The remaining portions of the cover bottom sheet peripheral edge 82 and cover top sheet peripheral edge 66 are selectively connectable by the zipper 78. While the cover top sheet 28 and cover bottom sheet 30 have been described as being connected along a portion of their respective peripheral edges 66, 82 and selectively connectable zipper 78, it should be understood that the cover top sheet 28 and cover bottom sheet 30 could be selectively connectable (for example by a zipper) around their entire respective peripheral edges 66, 82. It should also be understood that while the cover top sheet 28 and cover bottom sheet 30 are selectively connectable by a zipper 78, any means of selectively connecting the cover top sheet 28 to the cover bottom sheet 30 can be employed without departing from the scope of the invention. Preferably, the cover bottom sheet 30 is constructed out of a flexible plastic material that is both liquid and air impermeable. However, it should be understood that the use of rigid or less pliable materials, that are both liquid and air impermeable, in constructing the cover bottom sheet 30 is also possible without departing from the scope of the invention.

In the preferred embodiment, the cover bottom sheet 30 has pockets 84 that are each dimensioned and adapted to receive an air channel mat 24. The pockets 84 separate the air channel mats 24 and secure the air channel mats 24 to the cover bottom sheet 30. The cover bottom sheet 30 has opposite top and bottom surfaces 86, 88. The pockets 84 are on the cover bottom sheet top surface 86. When an air channel mat 24 is inserted into a pocket 84, the pocket 84 and the cover bottom sheet top surface 86 enclose the air channel mat bottom surface 54 and a portion 89 of the air channel mat top surface 52 at the margins. The pockets 84 form a seal between the pocket 84 and the air cell mattress base sheet 38 to direct a flow of air from the air pump 34 across the air channel mat top surface 52 and upwardly through the apertures 48 in the portion of the air cell mattress 22 above the air channel mat 24 residing within the pocket 84. While the moisture drying mattress 20 is shown as containing three air channel mats 24 and having three pockets 84, it should be understood that any number of air channel mats 24 and pockets 84 can be employed without departing from the scope of the invention.

Figure 6:
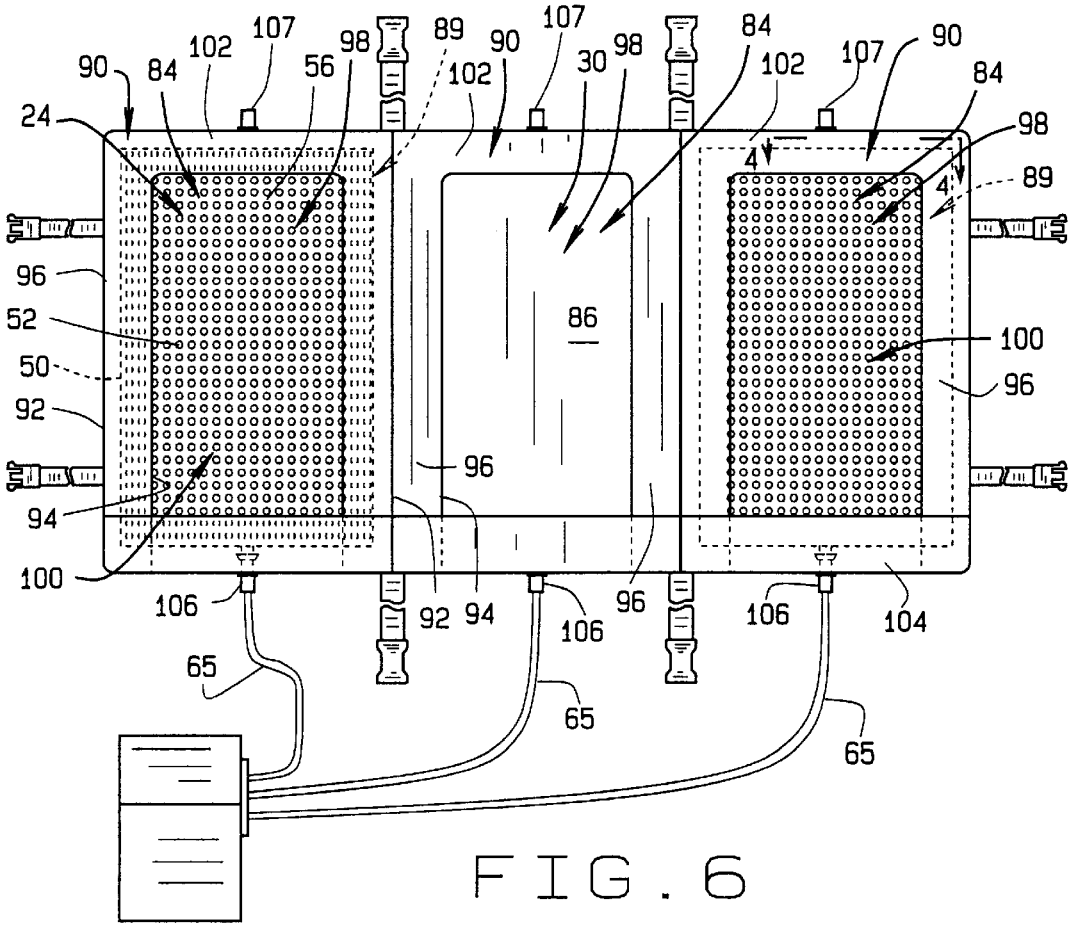
FIG. 6 is a plan view of the top surface of the cover bottom sheet showing the air channel mats inserted in two of the pockets.

Preferably, each pocket 84 is comprised of a frame 90 that is constructed of the same material as the cover bottom sheet and is attached to the bottom sheet top surface 86. The frame 90, as can best be seen in FIG. 6, has a general U-shape with an outer peripheral edge 92, an inner peripheral edge 94, and a margin 96 extending between the outer and inner peripheral edges 92, 94. The frame outer peripheral edge 92 is secured to the bottom sheet top surface 86 and the frame inner peripheral edge 94 defines an opening 98 in the frame 90. The margin of the air channel mat top surface 52 is enclosed by the overlapping frame margin 96. An exposed portion 100 of the air channel mat top surface 52 in the frame opening 94 is exposed to the air cell mattress base sheet 38. The plurality of projections 56 located on the exposed portion 100 engage with the air cell mattress base sheet 38. In the preferred embodiment, an elongated panel 104 overlaps and completes each of the frames that surround the frame openings 98.

While the pockets 84 have been described as being comprised of the U-shaped frames and the elongated panel, it should be understood that any type of configuration is may be utilized for the pockets that separates the air channel mats 24 and provides a seal between the pockets 84 and the air cell mattress base sheet 38 without departing from the scope of the invention.

Figure 7:
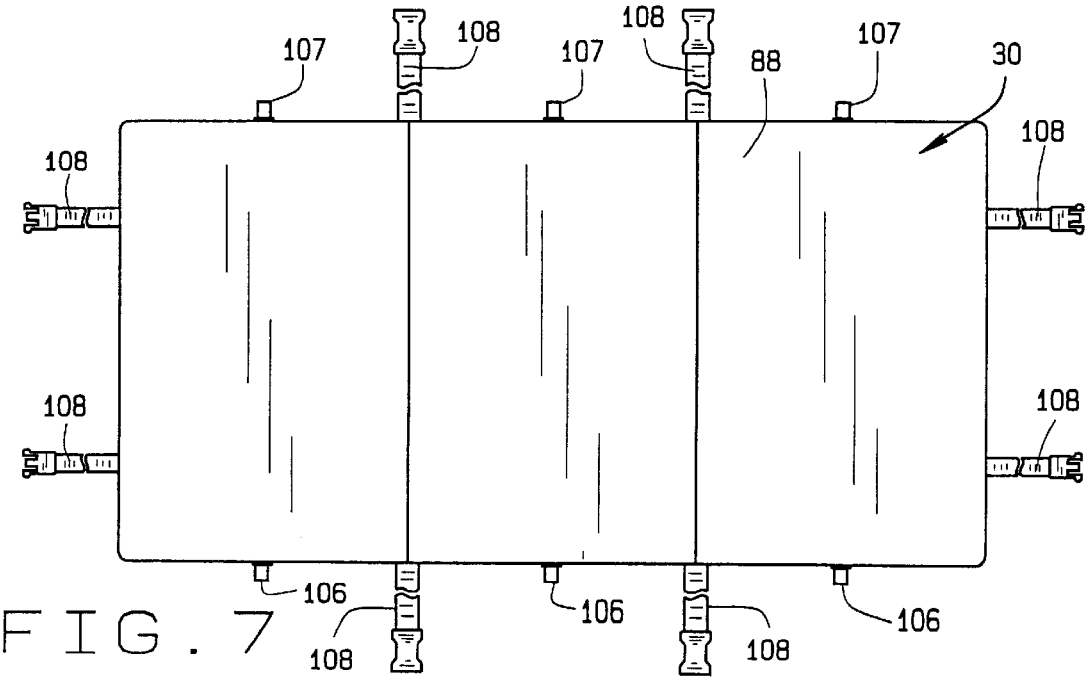
FIG. 7 is a plan view of the bottom surface of the cover bottom sheet.

In the preferred embodiment, the cover bottom sheet peripheral edge 82 has a plurality of snaps 80 and holes 106. The snaps 80 in the cover bottom sheet peripheral edge 82 engage with the snaps 80 on the top sheet flap 74 to selectively connect flap 74 to the cover bottom sheet peripheral edge 82. The holes 106 in the cover bottom sheet peripheral edge 82 provide access to the air supply connectors 64 on the air channel mats 24 to allow for the tubing 65 from the air pump 34 to be connected to the air supply connectors 64. The cover also includes at least one exhaust vent 107 for each air channel mat. The exhaust vent 107 allows for the discharge of evaporated vapor in use, as will be explained below. As can best been seen in FIG. 7, the cover bottom sheet bottom surface 88 is provided with a plurality of straps 108 that extend outwardly from the cover bottom sheet 30. The straps 108 serve to secure the moisture drying mattress 20 on a desired support surface (not shown), such as a bed in a hospital room.

The cover bottom sheet 30 is shown as having holes along opposite sides of the cover bottom sheet peripheral edge 82 to allow the air channel mats 24 to be connected to the air pump 34 from either side of the cover bottom sheet 30. While the holes 106 in the bottom cover sheet 30 have been described as being in the cover bottom sheet peripheral edge 82, it should be understood that the holes 106 can be in any portion of either the cover bottom sheet 30 or cover top sheet 28 that is convenient for the construction and use of the moisture drying mattress 20 without departing from the scope of the invention.

Figure 10:
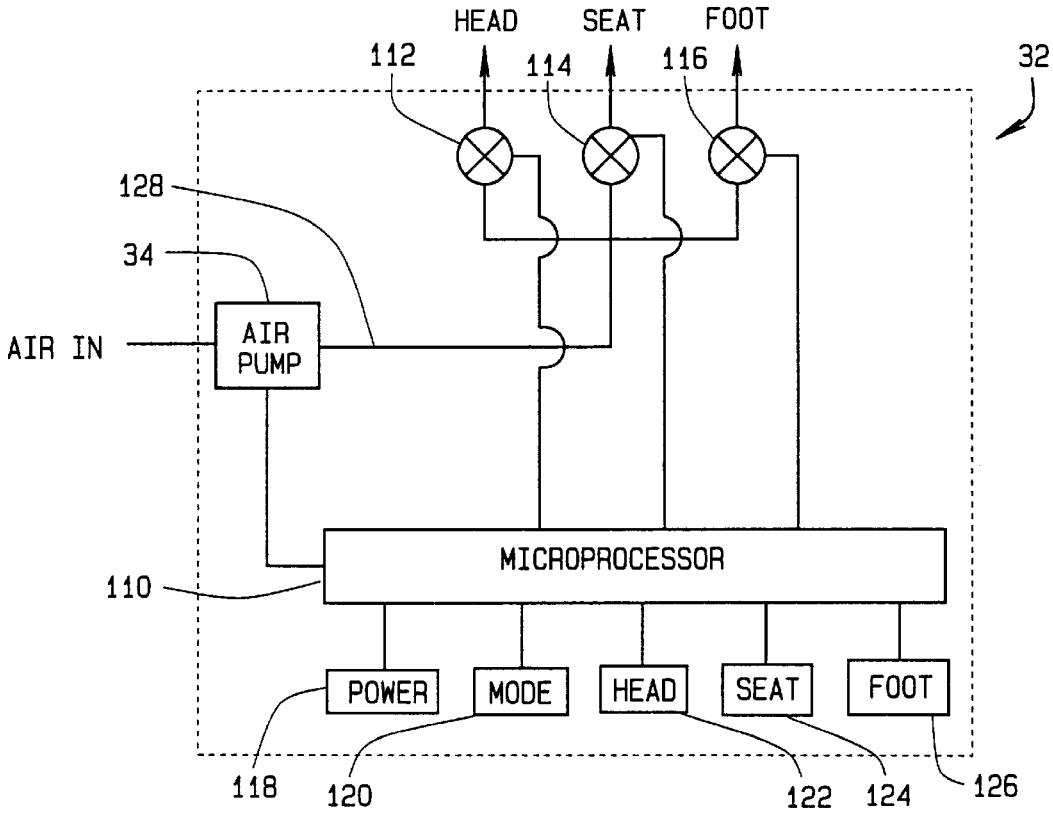
FIG. 10 is a schematic diagram of the operation of the controller of FIG. 9.

In the preferred embodiment, the controller 32, as can best been seen in the schematic of FIG. 10, includes the air pump 34, a microprocessor 110, a plurality of valves 112, 114, 116, and a plurality of adjustable inputs 118, 120, 122, 124, 126 to control air flow to the air channel mats 24. The plurality of valves comprise three valves with each valve being associated with one of the three air channel mats 24 that define a moisture vapor drying zone, as will be appreciated from the following description, and designated as head, seat and foot valves 112, 114, 116 respectively. The valves 112, 114, 116 are selectively positionable between opened and closed positions. Each valve 112, 114, 116 is connected to the output 128 of the air pump 34 and selectively allows a flow of air from the air pump 34 to flow through the valve 112, 114, 116, through the tubing 65, and to the associated air channel mat 24.

The valves 112, 114, 116 allow an air flow from the air pump 34 to flow through the valves 112, 114, 116, through the tubing 65, and to the associated air channel mats 24 when in the opened position. The valves 112, 114, 116 prevent an air flow from the air pump 34 from flowing through the valves 112, 114, 116,through the tubing 65, and to the associated air channel mats 24 when in the closed position. Each valve 112, 114, 116 is independently positionable between the opened and closed position and are controlled by the microprocessor 110.

Figure 9:
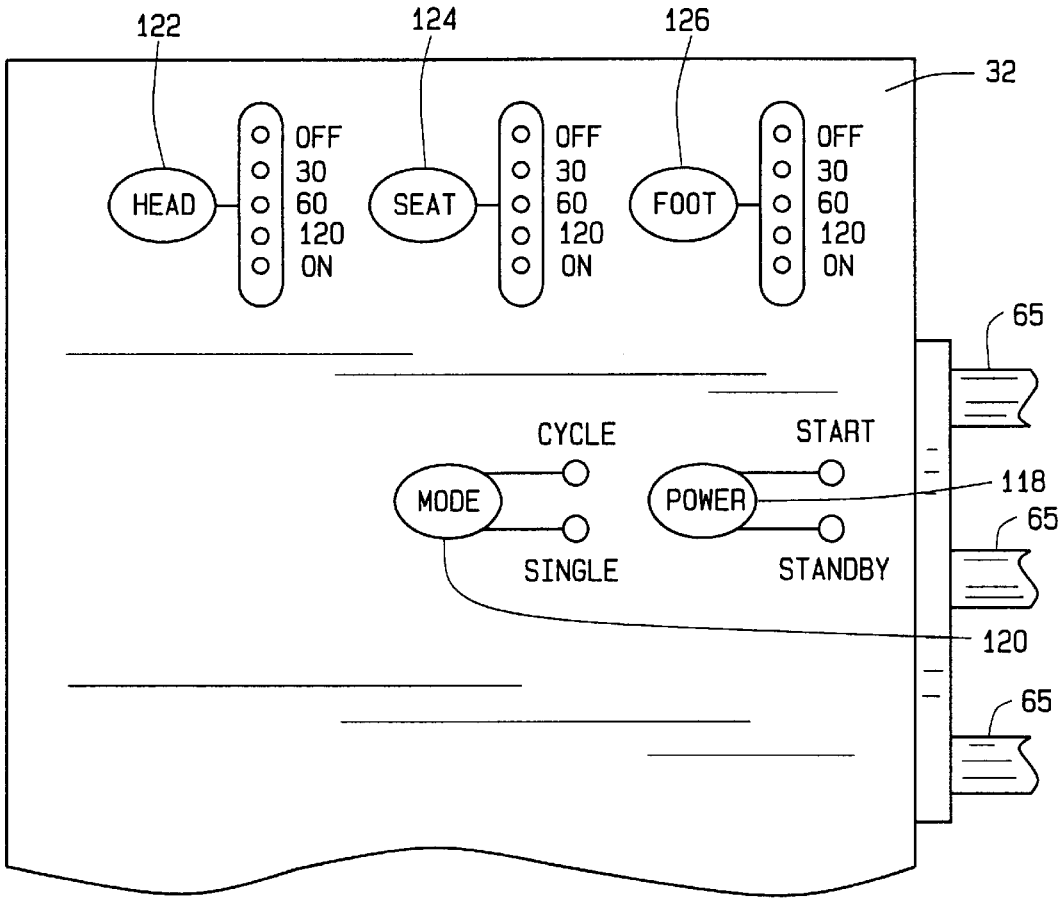
FIG. 9 is a plan view of a portion of the top of the air pump controller.

As shown in FIG. 9, the plurality of selectively adjustable inputs include a power input 118, a mode input 120, and inputs for the head, seat, and foot 122, 124, 126 respectively. The power input 118 is selectively adjustable between a start mode and a standby mode. The start mode corresponding to allowing a supply of power to the controller 32 and activating the controller 32. The standby mode corresponding to preventing the supply of power to the controller 32 and the activation of the controller 32. The head, seat and foot inputs 122, 124, 126 are each associated with a corresponding valve 112, 114, 116 respectively. The head, seat, and foot inputs 122, 124, 126 are each independently operated and each selectively controls the operation of the air pump 34 and the associated valve, 112, 114, 116. The head, seat, and foot inputs 122, 124, 126 are each selectively adjustable between three operational settings.

The first operational setting corresponds to de-activating the air pump 34 and closing the associated valve 112, 114, 116 to prevent an air flow to the associated air channel mat 24. The second operational setting corresponds to activating the pump and opening the associated valve 112, 114, 116 for one of three selectable time intervals, and then de-activating the air pump 34 and closing the associated valve 112, 114, 116 after the expiration of the selected time interval. The three selectable time intervals are 30 minutes, 60 minutes, and 120 minutes, as seen in FIG. 9. The third operational setting corresponding to activating the pump and opening the associated valve 112, 114, 116, it should be understood that the head, seat, and foot inputs 122, 124, 126 are independent of each other and regardless of which operational setting each of the head, seat, and foot inputs 122, 124, 126 are operating in, the different operational settings will not interfere with or disable each other. (i.e., when the head input 122 is in the first operational setting and de-activating the air pump 34, the head input 122 will not cause the seat or foot inputs 124, 126 to not function according to their operational settings by preventing or disrupting the activation of the air pump 34)

The mode input 120 controls the operation of the second operational setting of the head, seat, and foot inputs 122, 124, 126 and is selectively adjustable between two modes.

The first mode input setting corresponds to continuous cycling of the second operational setting between activating the air pump 34 and opening the associated valve 112, 114, 116 for the selected time interval and de-activating the air pump 34 and closing the associated valve 112, 114, 116 for the selected time interval. The second mode input setting corresponds to a single operation of the second operational setting which activates the air pump 34 and opens the associated valve 112, 114, 116 for the selected time interval and then de-activates the air pump 34 and closes the associated valve 112, 114, 116. While the second operational setting of the head, seat, and foot inputs 122, 124, 126 has been described as controlling the activation and de-activation of the air pump 34 and the opening and closing of the associated valves 112, 114, 116 for specific selectable time intervals, it is to be understood that any selectable time intervals can be employed or the user could enter any desired time interval without departing from the scope of the invention.

In use, a user of the moisture drying mattress 20 would begin by selectively adjusting the power input 118 to the start mode. The user would then select which parts or zones of the moisture drying mattress 20 are to receive a flow of air from the air pump 34. If the user desired to have the head portion of the moisture drying mattress 20 receive a flow of air from the air pump 34, the user would selectively adjust the head input 122 to either the second or third operational setting, thereby activating the air pump 34 and opening the associated head valve 112 so that air is supplied to that zone. The user could then, if desired, follow the same procedure for the seat and foot portions of the moisture drying mattress 20 to have those portions receive a flow of air from the air pump 34. If the user desires to prevent a flow of air to the head, seat, and/or foot portions of the moisture drying mattress 20, the user would selectively adjust the head, seat, and/or foot inputs 122, 124, 126 to the first operational setting.

If the user desired to have the air flow from the air pump 34 cycle between supplying air to the desired portion of the moisture drying mattress 20 for a selected time interval and not supplying air to the desired portion of the moisture drying mattress 20 for the selected time interval, the user would select one of the selectable time intervals in the second operational setting and adjust the mode input 120 to the cycle setting. If the user desired to have the air flow from the air pump 34 flow to a portion of the moisture drying mattress 20 for a single selected time interval, the user would adjust the head, seat, and/or foot inputs 122, 124, 126 to the desired second operational setting and adjust the mode input 120 to the single setting. The user can thereby control what portions of the moisture drying mattress 20 receive a flow of air and the duration of that flow of air.

Figure 11:
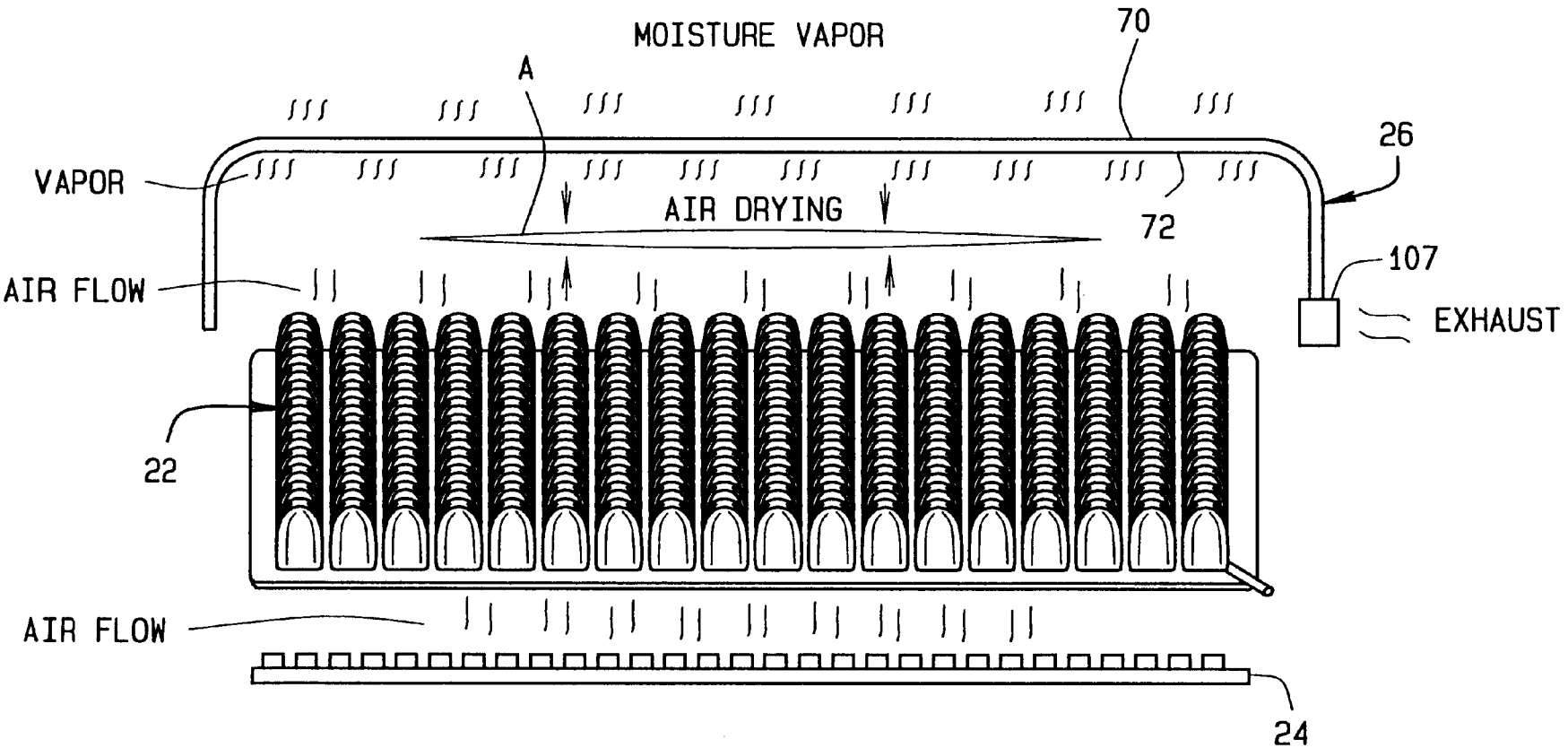
FIG. 11 is a schematic drawing illustrating the vapor evaporation feature of the moisture drying mattress of the present invention.

FIG. 11 graphically depicts how the moisture drying mattress 20 of the present invention dries moisture vapor which has permeated the cover and entered a selected moisture drying zone. An individual moisture drying zone is defined by a section of mattress 22 and an underlying air channel mat 24. As shown, the cover 26 is positioned around the mattress 20. The cover 26 and the mattress 22 define a vapor evaporation or air drying area A under the cover adjacent the mattress 22. As described in detail above, the laminated top surface of the cover, which has the nylon sheet 70 laminated to the urethane sheet 72, is permeable to moisture vapor but impermeable to liquid so as to wick moisture away from a user. Moisture vapor which gathers around a user positioned on the mattress 20 is wicked away from the patient and permeates the cover so as to accumulate in the drying area A as shown. The air pump is activated and air is forced to the air channel mat in the selected zone. Air flow from the air pump spreads through the air channel mat 24 and up through the apertures 48 in the base of mattress 22 to contact the vapor in area A and evaporate the vapor at the selected zone within area A and expell it through exhaust 107.

Figure 12:
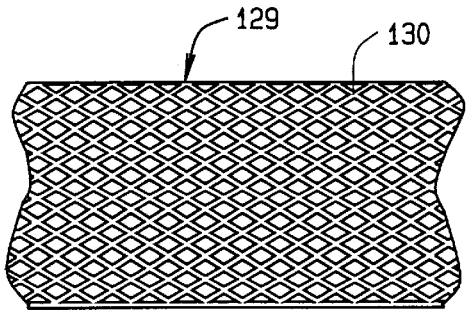
FIG. 12 is a top plan view of an alternative to the air channel mat.
Figure 13:
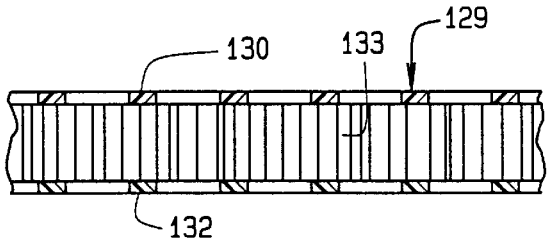
FIG. 13 is a side elevation thereof.

FIGS. 12 and 13 illustrate an alternative embodiment of an air channel mat in the form of a three dimensional spacer fabric, indicated generally in the drawings by reference numeral 129 employed in the moisture drying mattress of the present invention. As shown, the spacer fabric 129 includes a top layer 130 formed in a woven honeycomb design, a similar bottom layer or base 132 with a supportive mesh 133 in between the layers formed from a plurality of resilient filaments 134 of positioned between the top and bottom layers. The opposite ends of each filaments being integral with the top and body layers of the spacer fabric, respectively. The spacer fabric 129 is flexible, lightweight, resilient and has a cushioning effect. The spacer fabric is sufficiently flexible, resilient and supportive so as to be comfortable for a user positioned on the mattress. It is extremely air permeable and there is sufficient space between the plurality of filaments to allow air to be dispersed through the spacer fabric and to flow out of the spacer fabric through the top and bottom layers. The spacer fabric resists compression and remains air permeable when pressure is evenly applied, for example, when a user reclines on the mattress. One such three dimensional spacer fabric that works well in this application is Article #5900, Tytex, Inc. (Woonsocket, R.I.).

Figure 14:
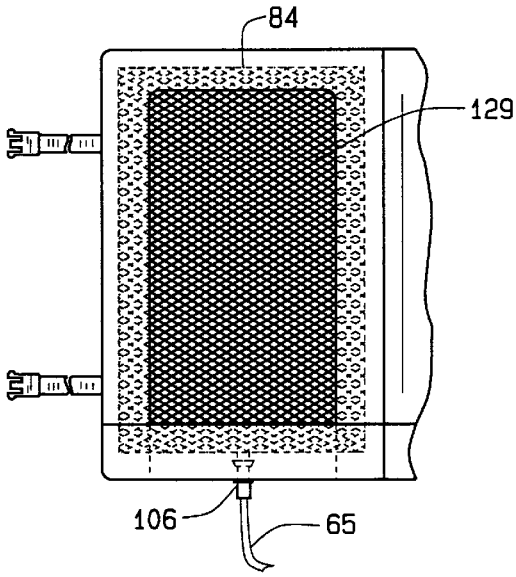
FIG. 14 is a cross-sectional view of a mattress, similar to FIG. 5, employing one alternative to the air flow mat.
Figure 15:
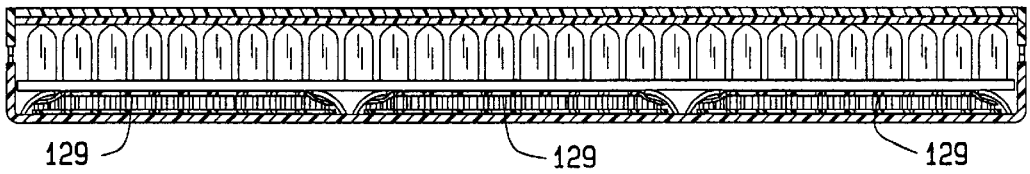
FIG. 15 is a plan view of the top surface of an alternative embodiment of the bottom of the cover.

FIGS. 14 and 15 illustrate one use of spacer fabric 129 as an air channel mat. The spacer fabric is positioned within a pocket 84 in the cover bottom to support the air cell mattress 22. As explained above, the cover bottom sheet 30 has opposite top and bottom surfaces 86, 88. The pockets 84 are on the cover bottom sheet top surface 86. When the spacer fabric 129 is inserted into a pocket 84, the pocket 84 and the cover bottom sheet top surface 86 enclose the margins of the spacer fabric. Each section of spacer fabric and the corresponding cushion section defines a vapor evaporation zone. The pockets 84 form a seal between the pocket 84 and the air cell mattress base sheet 38 to direct a flow of air from the air pump 34 through the spacer fabric where it is dispersed among the filaments and flows and upwardly through the fabric and the apertures 48 in the portion of the air cell mattress 22 above the spacer fabric section residing within the pocket 84 so as to evaporate the moisture vapor in that zone. The air is exhausted through the exhausts openings 107.

Figure 16:
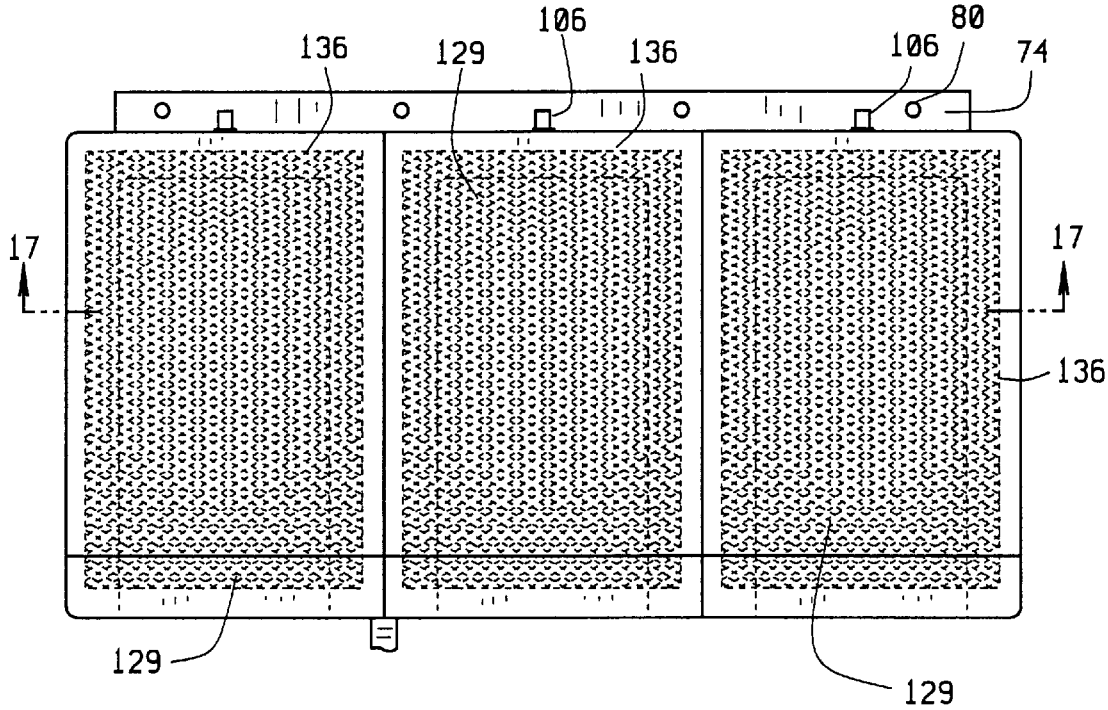
FIG. 16 is a plan view of the bottom surface of an alternative embodiment of the top of the cover.
Figure 17:
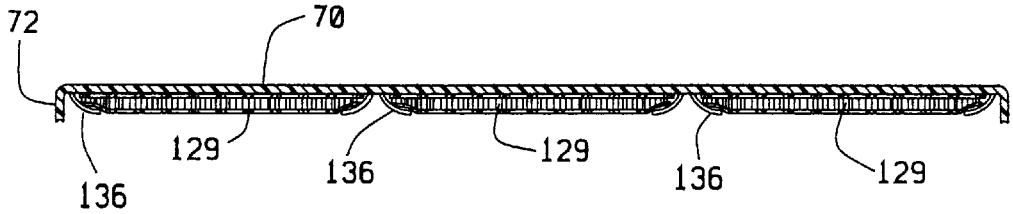
FIG. 17 is a cross sectional view of the alternative embodiment of the cover top taken along line 17—17 of FIG. 16.

FIGS. 16 and 17 illustrate another embodiment of the moisture drying mattress of the present invention wherein the air employed to evaporate the moisture in the moisture drying area A is introduced from the top down, rather than the bottom up. As shown, the cover top sheet 28 has an outer nylon layer 70 and the urethane laminate layer 72, as previously described. In this embodiment, pockets 136 are formed on the inner surface of the cover sheet below the urethane laminate. The pockets can be formed from nylon or other appropriate material. A section of spacer fabric 129 is secured in each pocket 136 and defines an vapor evaporation zone. The pockets are separated to create discrete zones. There are holes 106 in the peripheral edge of each pocket to provide access to the air supply connectors 64 to allow for the tubing 65 from the air pump 34 to be connected to the air supply connectors 64. Any arrangement of elements, however, which allows air flow to the spacer fabrice would be acceptable. In this embodiment, moisture vapor that permeates the top cover may accumulate within the support fabric so that each section of support fabric as well as the area above the mattress functions as a vapor evaporation zone. In use, the pump delivers air to a selected support fabric section or zone, as prevously described. The air is diffused and flows through the surfaces of the support fabric toward the mattress to evaporate any moisture vapor within the support fabric or the vapor evaporation area A. The air is exhausted from the vents 107, which may be formed in the top or bottom cover.

While the present invention has been described by reference to specific embodiments, it should be understood that modifications and variations of the invention may be constructed without departing from the scope of the invention as defined by the following claims.

What is claimed is:

1. A moisture drying mattress comprising:

at least one cushion having opposite top and bottom surfaces and a plurality of apertures extending through the cushion from the bottom surface to the top surface;

at least one air channel mat, the at least one air channel mat having a base and being dimensioned and adapted to fit beneath the at least one cushion and support the at least one cushion bottom surface in a spaced relation from the base;

a cover encasing said at least one cushion and said at least one air channel mat and defining a moisture drying space between the cover and the at least one cushion and said at least one air channel mat, said cover being pervious to moisture vapor flowing into the moisture drying space but impervious to moisture vapor and air within the moisture drying space whereby moisture vapor can pass through said cover into said space to be evaporated in the moisture drying space while moisture vapor and air within the moisture drying space does not pass through the cover to contact a user positioned on the mattress; and a selectively operable air pump for selectively supplying an air flow to the at least one air channel mat, the air flow supplied to the at least one air channel mat flowing through the air channel mat between the base and the cushion bottom surface and upwardly through the cushion apertures to remove moisture vapor which has passed through said cover and has accumulated in said moisture drying space at said at least one cushion and said at least one air channel mat.

2. The moisture drying mattress of claim 1, wherein the at least one air channel mat is a spacer fabric.

3. The moisture drying mattress of claim 1, wherein:

the at least one air channel mat has a peripheral edge separating opposite top and bottom surfaces of the base and a plurality of projections along the base, the plurality of projections extending upwardly from the base top surface and engaging with the at least one cushion bottom surface to support the at least one cushion bottom surface in a spaced relation from the base top surface.

4. The moisture drying mattress of claim 3, wherein:

the air pump has an outlet that communicates with the at least one air channel mat to supply an air flow to the at least one mat that flows over the base top surface of the mat between the projections and the cushion bottom surface and upwardly through the cushion apertures.

5. The moisture drying mattress of claim 1, wherein:

a top surface of the cover is comprised of a nylon sheet laminated to a urethane sheet.

6. The moisture drying mattress of claim 1, wherein:

the at least one cushion is further comprised of at least one air impervious base sheet and at least one air impervious top sheet, the air impervious top sheet is preformed with a plurality of air cells and is secure to the base sheet with the air cells extending outwardly from the base sheet, the air cells are interconnected to permit air flow therebetween, and the apertures extend through the base sheet and top sheet and do not communicate with the air cells.

7. The moisture drying mattress of claim 1, wherein:

the at least one cushion is an air cell mattress comprised of a plurality of air cells.

8. The moisture drying mattress of claim 7, wherein:

the air cell mattress is further comprised of at least one air impervious base sheet and at least one air impervious top sheet, the air impervious top sheet is preformed with the plurality of air cells and is secured to the base sheet with the air cells extending outwardly from the base sheet, the air cells are interconnected to permit air flow therebetween, and the apertures extend through the base sheet and top sheet and do not communicate with the air cells.

9. The moisture drying mattress of claim 1, wherein:

the at least one cushion is a non-inflatable cushion.

10. A moisture drying mattress comprising:

at least one cushion having opposite top and bottom surfaces and a plurality of apertures extending through the cushion from the bottom surface to the top surface;

a plurality of air channel mats, each air channel mat having a base and being dimensioned and adapted to fit beneath the at least one cushion and support the at least one cushion bottom surface in a spaced relation from the base;

a cover over said at least one cushion defining a vapor evaporating area below the cover at the at least one cushion; and a selectively operable air pump for selectively supplying an air flow to the plurality of air channel mats, the air flow supplied to the mats flowing over the mats between the base and the cushion bottom surface and upwardly through the cushion apertures to evaporate moisture in the vapor evaporating area, but not flowing through the cover to contact the skin of a user positioned on the mattress.

11. The moisture drying mattress of claim 10, wherein:

the plurality of air channel mats each have a peripheral edge separating opposite top and bottom surfaces of the base and a plurality of projections extending upwardly from the base and engaging with the at least one cushion bottom surface to support the at least one cushion bottom surface in a spaced relation from the base top surface.

12. The moisture drying mattress of claim 11, wherein the projections are truncated cones.

13. The moisture drying mattress of claim 10, wherein the air channel mat is a spacer fabric.

14. The moisture drying mattress of claim 10, wherein:

the air pump has an outlet that communicates with an air supply connector associated with each of the plurality of air channel mats to supply an air flow to the mats that flows through the air channel mats and upwardly through the cushion apertures.

15. The moisture drying mattress of claim 10, wherein:

the air pump outlet is a plurality of air outlets, each outlet being connected to a valve that is selectively positionable between opened and closed positions, the valves being connected between the outlets and the air supply connectors of the air channel mats, each valve being associated with one air channel mat and allowing a flow of air from the air pump through the valve and to the associated air channel mat when in the opened position and preventing a flow of air from the air pump through the valve and to the associated air channel mat when in the closed position, thereby allowing a user to selectively choose which air channel mats receive an air flow from the air pump.

16. The moisture drying mattress of claim 15, further comprising:

an air supply controller for controlling a flow of air to the plurality of air channel mats, the controller being connected to the valves and the air pump and having a plurality of selectively adjustable inputs, the inputs controlling the opening and closing of the valves and the operation of the air pump.

17. The moisture drying mattress of claim 16, wherein:

the inputs control cyclic opening and closing of the valves for predetermined periods of time.

18. A moisture drying mattress comprising:

at least one cushion having opposite top and bottom surfaces and a plurality of apertures extending through the cushion from the bottom surface to the top surface;

at least one air channel mat, the at least one air channel mat having a base and being dimensioned and adapted to fit beneath the at least one cushion and support the at least one cushion bottom surface in a spaced relation from the base;

a cover encasing said at least one cushion and said at least one air channel mat and defining a space at the least one cushion and said at least one air channel mat, said cover being pervious to moisture vapor but impervious to liquid from outside the cover whereby moisture vapor can pass through said cover into said space, the cover further comprising a top sheet with a peripheral edge and a bottom sheet with a peripheral edge, the top sheet and bottom sheet being connected together along portions of their peripheral edges leaving an opening between their peripheral edges that provides access to an interior of the cover between the top sheet and bottom sheet, the bottom sheet having a plurality of pockets in the cover interior that are each dimensioned and adapted to receive one of the plurality of air channel mats in the pockets, each pocket covering a margin of the air channel mat top surface leaving an exposed portion of the base top surface where the projections of the exposed portion of the base top surface engage with the cushion bottom surface, and a selectively operable air pump for selectively supplying an air flow to the at least one air channel mat, the air flow supplied to the at least one air channel mat flowing through the air channel mat between the base and the cushion bottom surface and upwardly through the cushion apertures to remove moisture vapor which has passed through said cover and has accumulated in said space at said at least one cushion and said at least one air channel mat.

19. The moisture drying mattress of claim 18, wherein:

the pockets separate the air channel mats and form a seal between the pockets and the cushion bottom surface.

20. A moisture drying cushion for drying of moisture vapor associated with an individual positioned on the cushion, comprising:

at least one cushion having opposite top and bottom surfaces and a plurality of apertures extending through the cushion from the bottom surface to the top surface;

an air channel mat having a base with a peripheral edge and opposite top and bottom surfaces, the air channel mat being dimensioned and adapted to fit beneath the at least one cushion bottom surface and support the at least one cushion bottom surface;

an air supply pump communicating with the air channel mat to supply an air flow to the air channel mat and through the air channel mat between the base top surface and the at least one cushion bottom surface and through the plurality of apertures in the at least one cushion;

and a cover dimensioned and adapted to enclose the at least one cushion and the air distribution member thereby forming a vapor evaporation zone under the cover for the containment and drying of the moisture vapor permeating into the vapor evaporation zone through the cover, the cover having at least one exhaust opening therein.

21. The moisture drying mattress of claim 20, wherein:

the cover is a top surface that is comprised of a nylon sheet laminated to a urethane sheet, the urethane sheet is positioned between the nylon sheet and the at least one cushion, the laminated sheets making the top surface vapor permeable and liquid impermeable.

22. The moisture drying mattress of claim 20, wherein:

the cover is comprised of a top sheet with a peripheral edge and a bottom sheet, the top sheet having the top surface and the bottom sheet having at least one pocket in the cover interior that is dimensioned and adapted to receive the air channel mat in the at least one pocket, the at least one pocket covering a margin of the air channel mat leaving an exposed portion of the air channel mat exposed to the at least one cushion.

23. The moisture drying mattress of claim 22, wherein:

the at least one pocket forms a seal between the pocket and the cushion bottom surface.

24. The moisture drying mattress of claim 23, wherein:

the air channel mat is one of a plurality of air mats, each air channel mat communicating with the air supply pump and being independently supplied with an air flow from the air pump; and the at least one pocket is a plurality of pockets, the plurality of pockets separating the plurality of air channel mats and forming a seal between the pockets and the cushion bottom surface.

25. The moisture drying mattress of claim 24, further comprising:

a plurality of valves equal in number to the plurality of air channel mats, each valve being associated with one of the plurality of air channel mats and located between the associated air channel mat and the air supply pump, the valves being selectively positionable between opened and closed positions and allowing the air flow to flow from the air pump to the associated air channel mat when in the opened position and preventing the air flow from the air pump from flowing to the associated air channel mat when in the closed position; and an air flow controller for controlling the air flow to each of the plurality of air channel mats, the controller being connected to the valves and the air pump and having a plurality of selectively adjustable inputs, the inputs controlling the opening and closing of the valves and the operation of the air pump.

26. The moisture drying mattress of claim 25, wherein:

the inputs control cyclic opening and closing of the valves for predetermined periods of time.

27. The moisture drying mattress of claim 20, wherein:

the at least one cushion is an air cell mattress comprised of a plurality of air cells.

28. The moisture drying mattress of claim 20, wherein;

the at least one cushion is not inflatable.

29. The moisture drying mattress of claim 20, wherein:

the air channel mat is a spacer fabric.

30. A moisture vapor drying mattress assembly, comprising:

at least one cushion having opposite top and bottom surfaces and a plurality of apertures extending through the cushion from the bottom surface to the top surface;

at least one air distribution member having a base with a peripheral edge and opposite top and bottom sides, the air distribution member being dimensioned and adapted to fit beneath the at least one cushion bottom surface and support the at least one cushion bottom surface in a spaced relation from the base top side, each said air distribution member defining a moisture vapor drying zone;

a top sheet that is pervious to moisture vapor but impervious to liquid defining a moisture vapor drying area comprising at least one moisture vapor drying zone under the top sheet;

a bottom sheet with a peripheral edge with at least one exhaust opening therein, the bottom sheet having opposite top and bottom surfaces, the bottom sheet top surface having at least one pocket, the at least one pocket being dimensioned and adapted to receive the at least one air distribution member and enclose the base bottom side and a portion of the base top side of the at least one air distribution member; and a selectively operable air pump for selectively supplying an air flow to the at least one air distribution member, the air flow flowing across the air distribution member between the air distribution member top side and the cushion bottom surface and upwardly through the cushion apertures to a selected moisture vapor drying zone.

31. The moisture vapor drying mattress assembly of claim 30, wherein:

the at least one air distribution member is a plurality of air distribution members and the at least one pocket is a plurality of pockets, the number of pockets being equal to the number of air distribution members, each air distribution member being independent of other air distribution members and each pocket separating the air distribution members.

32. The moisture vapor drying mattress assembly of claim 30, wherein:

the air distribution member is an air channel mat having a plurality of discrete support members thereon.

33. The moisture vapor drying mattress assembly of claim 30, wherein:

the air distribution member is a spacer fabric.

34. The moisture drying mattress of claim 31, further comprising:

a plurality of valves equal in number to the number of air distribution members, each valve being associated with one air distribution member and located between the associated air distribution member and the air pump, the valves being positionable between opened and closed positions and allowing an air flow from the air pump to the associated air distribution members when in the opened position and preventing an air flow from the air pump to the associated air distribution members when in the closed position; and an air controller for controlling air flow to the plurality of air distribution members, the air controller being connected to the valves and the air pump and having a plurality of selectively adjustable inputs, the adjustable inputs controlling the opening and closing of the valves and the operation of the air pump.

35. The moisture drying mattress of claim 34, wherein:

the inputs control cyclic opening and closing of the valves for predetermined periods of time.

36. The moisture drying mattress of claim 30, wherein:

at least a portion of the cover top sheet is comprised of a nylon sheet laminated to a urethane sheet.

37. A moisture drying mattress comprising:

at least one cushion having opposite top and bottom surfaces and a plurality of apertures extending through the cushion from the bottom surface to the top surface;

a plurality of air channel mats, each air channel mat having a base and being dimensioned and adapted to fit beneath the at least one cushion and support the at least one cushion bottom surface in a spaced relation from the base, each said air channel mat defining a vapor drying zone;

a cover encasing said at least one cushion and plurality of air channel mats creating a vapor drying space below the cover at each vapor drying zone for evaporation of moisture vapor by a flow of air within the vapor drying space, said cover being pervious to surface moisture vapor to allow moisture vapor into the vapor drying space and impermeable to liquid to prevent liquid from outside the cover from entering the mattress and also impermeable to the flow of air within the vapor drying space to prevent the flow of air within the vapor drying space from passing through the cover; and a selectively operable air pump for selectively supplying an air flow to the plurality of air channel mats, the air flow supplied to the mats flowing over the mats between the base and the cushion bottom surface and upwardly through the cushion apertures to remove moisture vapor by the flow of air in the vapor drying space.

38. The moisture drying mattress of claim 37, wherein:

a top surface of the cover is comprised of a nylon sheet laminated to a urethane sheet.

39. The moisture drying mattress of claim 37, wherein:

the at least one cushion is an inflatable cushion.

40. The moisture drying mattress of claim 37, wherein:

each said air channel mat is a spacer fabric.

41. A vapor drying mattress comprising:

at least one cushion;

a cover over said at least one cushion, said cover having a top and a bottom, said top having an outer layer and an inner layer laminated to said top layer, said cover being impermeable to fluid but permeable to moisture vapor;

at least one pocket at the inner layer of the cover top;

an air diffuser positioned in the at least one pocket, said pocket and air diffuser defining a moisture drying zone below said cover;

an air pump operatively connected to the at least one pocket for selectively supplying an air flow to the air diffuser, the air flow supplied to the air diffuser flowing through the air diffuser toward the moisture drying zone to remove moisture vapor by a flow of air in the moisture drying zone.

42. The vapor drying mattress of claim 41 wherein the top outer layer is nylon and the inner layer is urethane.

43. The vapor drying mattress of claim 41 wherein the air diffuser is a flexible, lightweight, air permeable air diffuser.

44. The vapor drying mattress of claim 43 wherein the air diffuser is a spacer fabric.

45. The vapor drying mattress of claim 41 where in the at least one cushion is an inflatable cushion.

* * * * *